United States Patent [19]

McConnel

[11] 4,343,259

[45] Aug. 10, 1982

[54] APPARATUS FOR APPLYING ADHESIVE IN CORRUGATED BOARD MANUFACTURE

[75] Inventor: Ronald J. McConnel, Seattle, Wash.

[73] Assignee: Weyerhaeuser Company, Tacoma, Wash.

[21] Appl. No.: 167,617

[22] Filed: Jul. 11, 1980

[51] Int. Cl.[3] ..... B05C 5/02; B05C 11/04

[52] U.S. Cl. ..... 118/44; 118/126; 118/410

[58] Field of Search ..... 118/407, 410, 413, 126, 118/44; 427/356, 358

[56] References Cited

U.S. PATENT DOCUMENTS

| | | | |
|---|---|---|---|
| 2,464,771 | 3/1949 | VanGuelpen | 118/410 X |
| 3,285,225 | 11/1966 | Recor | 118/413 X |
| 3,348,526 | 10/1967 | Neubauer | 118/410 |
| 3,518,142 | 6/1970 | Dooley | 156/205 |
| 3,521,602 | 7/1970 | Coghill | 118/410 X |
| 3,972,763 | 8/1976 | Wolven et al. | 156/210 |
| 4,158,076 | 6/1979 | Wallsten | 118/410 X |
| 4,223,633 | 9/1980 | Alvensleben et al. | 118/410 X |

*Primary Examiner*—John P. McIntosh

*Attorney, Agent, or Firm*—Weyerhaeuser Company

[57] ABSTRACT

The invention comprises an extrusion head for coating or adhesive application. The head is particularly well adapted for application of high viscosity hot melt adhesives in the manufacture of corrugated board. It comprises the combination of a body having a slit or series of orifices with a thin, flexible downstream spreader element. The spreader element contacts the coating receiving surface at a low acute angle to level the coating material but does not serve as a doctor to control coating thickness.

When used as the adhesive applicator at the single facer of a container board corrugating machine, excellent pin adhesion values were obtained at adhesive usages as low as 6 g/m$^2$.

10 Claims, 11 Drawing Figures

APPARATUS FOR APPLYING ADHESIVE IN CORRUGATED BOARD MANUFACTURE

BACKGROUND OF THE INVENTION

This invention relates to an improvement in extrusion heads, especially to those for use in coating applications. The invention is especially well adapted for application of adhesives in the manufacture of corrugated container board.

Paper coaters tend to be massive and expensive pieces of equipment. Both size and cost are a function of the requirements for rigidity and precision. A lower cost coater which is simple in concept has long been a need in the industry. Application of adhesive during the manufacture of corrugated board can be considered as a coating operation using a modified print-type coater. The adhesive is typically starch based and of relatively low viscosity.

A market need for corrugated board having improved moisture resistance has prompted a number of innovations using different board materials and adhesives. As examples, U.S. Pat. Nos. 3,518,142 and 3,972,763 show the use of hot melt adhesives for the manufacture of corrugated board. These adhesives are about two orders of magnitude higher viscosity than typical starch based adhesives and cannot be handled on conventional applicators designed for starch. In addition, they are much more expensive than starch. Economic considerations dictate that very low spreads are essential. Achieving good bond strength between corrugated medium and liners at very low adhesive spreads has been a major challenge not successfully met until the advent of the present invention.

United States patent applications, Ser. No. 836,181, filed Sept. 23, 1977 and Ser. No. 16,639 filed Mar. 1, 1979, now U.S. Pat. No. 4,223,633, commonly owned by the present assignee, show improvements in corrugator adhesive systems designed to better handle high viscosity hot melts. These applications are incorporated herein by reference.

One problem encountered with hot melt systems is oxidation and deterioration of the adhesive on exposure to air. Virtually, all adhesive applicators designed to apply hot melts in corrugating operations involve air exposure and recycling of much of the thus exposed adhesive. Oxidation results in the formation of gels that can plug filters or orifice nozzles on the glue applicator manifolds.

The desirability of direct application of a precisely metered amount of adhesive from an extruder onto the tips of the corrugated medium soon became apparent. This approach was suggested in U.S. Pat. No. 3,518,142. Unfortunately, there was no available system to perform this operation. A laboratory scale apparatus using a simple extrusion head showed that inordinately high amounts of adhesive were needed to get satisfactory bonds. Perusal of the literature showed a number of coaters with a raised downstream land or dam; e.g., U.S. Pat. Nos. 2,464,771 or 3,521,602, designed to promote coating uniformity. This approach on corrugator hot melt extrusion applicator gave improved results over a flush extruder face. However, useage of the expensive hot melt adhesives was still excessive if acceptable bond strengths were to be obtained. At least in part, this appeared to be a result of nonuniform adhesive distribution around the flute tip. The leading edges of the flutes appeared to be overspread while the trailing edges seemed starved of adhesive.

SUMMARY OF THE INVENTION

The article of this invention is an extrusion head particularly well adapted for applying coatings. In this context, an adhesive applied to a continuously moving substrate material is considered to be a coating. The extrusion head comprises an elongate body portion having an internal chamber and an external application surface. The internal chamber is in communication with a source of coating material under pressure. It also communicates with a longitudinal slit or series of orifices passing through the application surface. The application surface is the area most closely adjacent to the material being coated.

Integral with the body portion is a relatively thin, flexible spreader element. This is oriented parallel to and downstream from the slit or orifices and has a basal or proximal edge fixed to the body block. The distal edge of the spreader is free and is raised above the highest level of the application surface. The spreader is in wiping contact at an acute angle with the moving receiving surface and serves to assist in leveling the coating without any significant amount of coating removal. In this regard, no readily apparent puddle of coating material builds up behind (upstream) from the spreader element. Because of the close clearances between the extrusion head and the coating receiving substrate, the formation of a puddle would be undesirable and the spreader element must be sufficiently flexible to insure that this does not occur.

The extrusion head is particularly advantageous as an adhesive applicator in the manufacture of corrugated containerboard. It is capable of handling adhesives of a very wide range of viscosities. In particular, when used with hot melt-type adhesives, it gives combined boards having excellent liner to corrugated medium adhesion with very low adhesive spreads. The head may be used with equal efficiency at either the single facer or double backer stations.

It is thus an object of this invention to provide an extrusion head that is relatively simple and lightweight in construction that can handle coating materials having a wide range of viscosities.

It is a further object to provide an extrusion head that is versatile in a number of areas of coating application.

It is yet an object to provide an adhesive applicator for a paperboard corrugating machine that can effectively apply hot melt adhesives without the need to recycle adhesive.

It is another object to provide a hot melt adhesive applicator for a paperboard corrugating mahcine that will give high medium to liner adhesion strengths at very low adhesive useages.

These and many other objects can be more fully appreciated by reading the following detailed description and referring to the drawings.

DESCRIPTION OF THE PREFERRED EMBODIMENTS

The invention will now be described in detail. It can be best understood by using the following description in conjunction with the attached drawings.

There is considerable latitude in the geometric configuration of the extrusion head. This will in part be controlled by the geometry required in the particular situation in which the extrusion head will be employed. While all of the drawings illustrate the extrusion head in the context of an adhesive applicator for a corrugating machine, it should be understood that the invention is not limited to this application. It has equal applicability as, for example, a paper coater.

Figure 6:
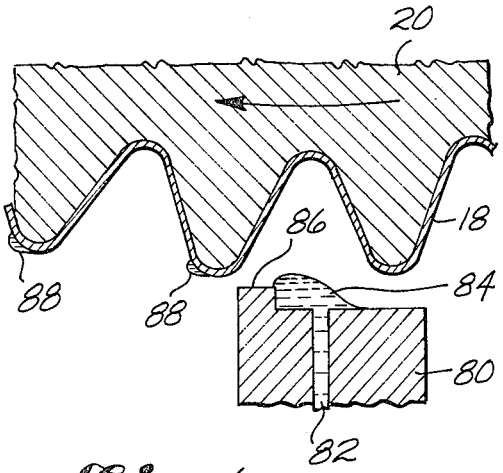
FIG. 6 is a diagrammatic representation in a cross-section of a prior art extrusion head applying adhesive to the flute tips of corrugated medium.

Normally, in making corrugated shipping containers, the adhesive is applied to the flute tips while the corrugated medium is still held on the lower of two corrugating rolls. Typically this adhesive will be starch based. It is normally applied as a metered film from an applicator roll. In recent years engineers have designed systems in which corrugated shipping containers are constructed using non-aqueous adhesives. These give many advantages, among them being improved water resistance, potentially faster operating speeds and a smoother surface on the single face side of the board. The latter two advantages accrue because there is no need for the water present in conventional adhesives. It has been proposed to apply these adhesives by means of an extruder, such as is shown in FIG. 6 of U.S. Pat. No. 3,518,142. Prior to the present invention these attempts have not been successful.

Figure 1:
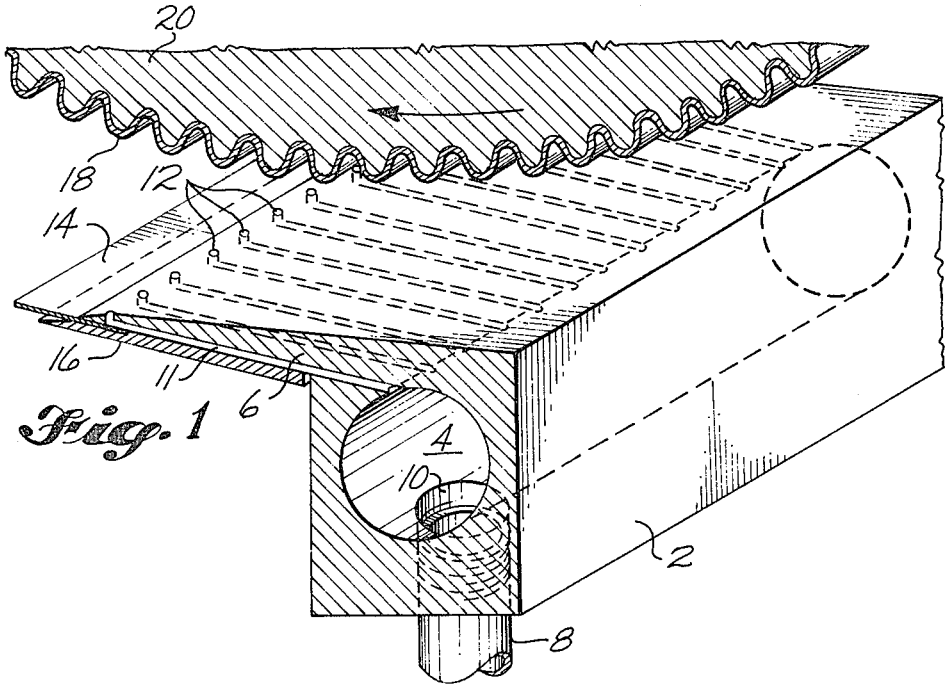
FIG. 1 is a partially cut away isometric view of one form of the extrusion head in use as an adhesive applicator on a corrugating machine.

As was described earlier, the key element of the present invention is the addition of a thin flexible lip, or spreader element immediately downstream from the extrusion head. This spreader element helps to wipe the adhesive around the flute to obtain a more uniform glue spread. An apparatus to accomplish this is shown in FIG. 1. A manifold block 2 contains an interior longitudinal chamber 4. This chamber may either be drilled or, in the case of complex shapes, can be formed integrally by an extrusion process. The head contains an elongated portion 6. Adhesive is supplied through a line 8 into the interior chamber 4 through tapped opening 10. The manifold contains a number of channels 11. In the present case these are defined by grooves milled into the under-surface of the elongated portion 6. The grooves are extended by drilling them through the main body of the manifold so that they are in communication with the interior chamber 4. A bottom retainer plate 16 serves to define the lower surface of the channels. A series of smaller orifice holes 12 are drilled through the upper surface of the extended portion 6 to meet the grooved channels below. A flexible lip or spreader element 14 is held immediately downstream from the orifices 12 by retainer plate 16. Adhesive extruded from the orifices is wiped onto the passion flutes of the corrugated medium 18 which is, at this point, still held to the lower corrugating roll 20 of a corrugating machine. This particular design has an advantage in that the spreader element need not be bent or hinged, as in the other designs exemplified. It is thus somewhat less subject to fatigue failure when used on a corrugator.

Figure 2:
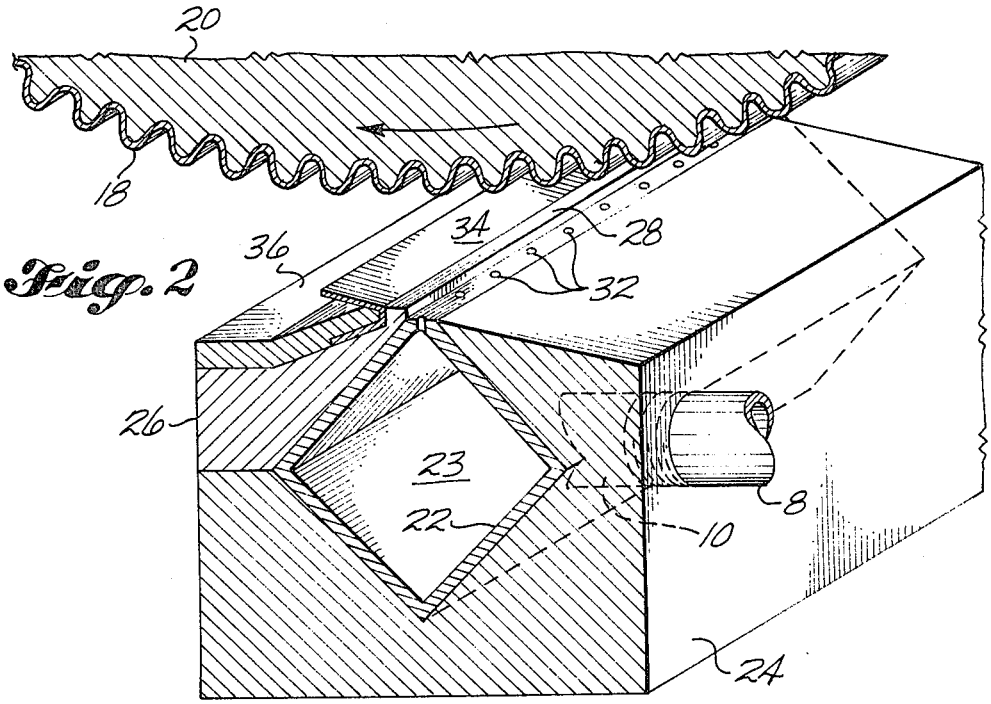
FIG. 2 is a partially cut away isometric view of a different form of the extrusion head.
Figure 3:
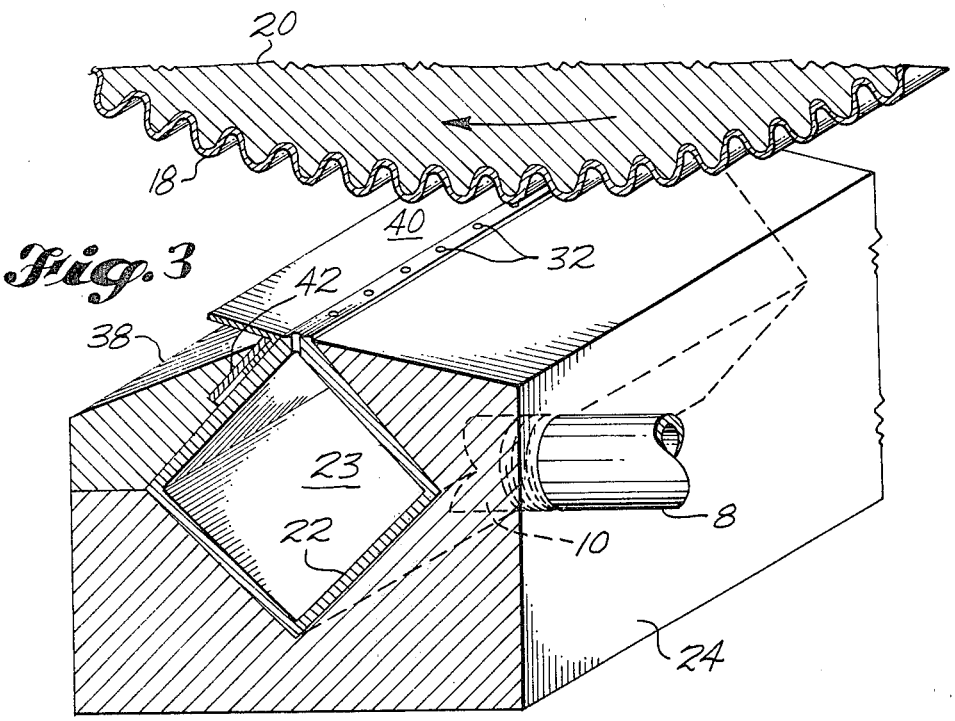
FIG. 3 shows an extrusion head slightly modified from that represented in the previous figure.

A somewhat simpler version of an extrusion head is shown in FIG. 2. In this case the manifold is built around a piece of readily available square tubing 22, which contains the interior chamber 23. For support, this is retained in a milled groove cut in a block of solid material 24. A retainer piece 26 holds the square tubing in place within the manifold assembly. In the version shown inthis figure, the retainer piece also defines a small land or dam 28, which is downstream from the orifice openings 32. The flexible spreader element is downstream from this land and is held in place by retainer plate 36. In some applications, the dam 28 may be advantageous and improve the bond strength or coating appearance. In other applications there is no advantage to using this land or dam. An extruder head, similar to the one in FIG. 2 but without the dam, is shown in FIG. 3. Here the construction of the square tube retainer block 38 is simplified. The thin flexible spreader element 40, is held by retainer block 38 and shim 42.

Figure 4:
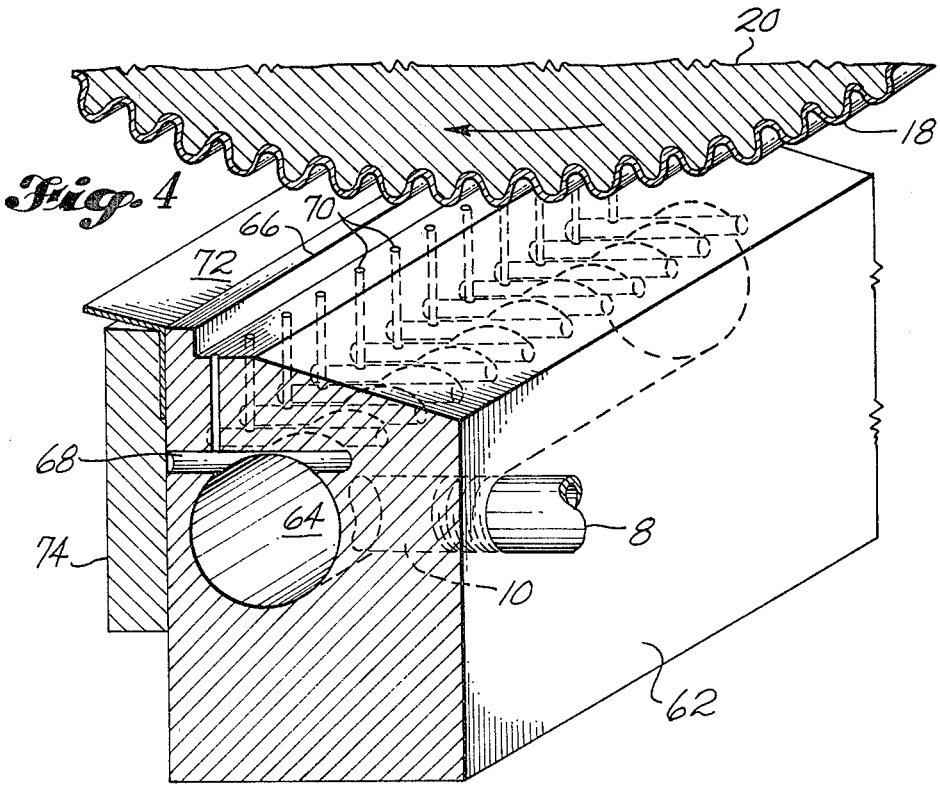
FIG. 4 is a partially cut away isometric view of a third configuration of the extrusion head, also shown in position as a glue applicator on a corrugating machine.

Another version of an extrusion head is shown in FIG. 4. Here the manifold block 62 contains an internal opening 64. Integral with this block is a land or dam 66. The orifices are created by drilling transverse holes 68 to intercept the internal chamber. Orifice holes 70 are drilled vertically to intercept the cross-bores 68. The thin flexible spreader element 72 in this case is held in place by retainer plate 74, which also serves as a seal for the crossbores.

Figure 5:
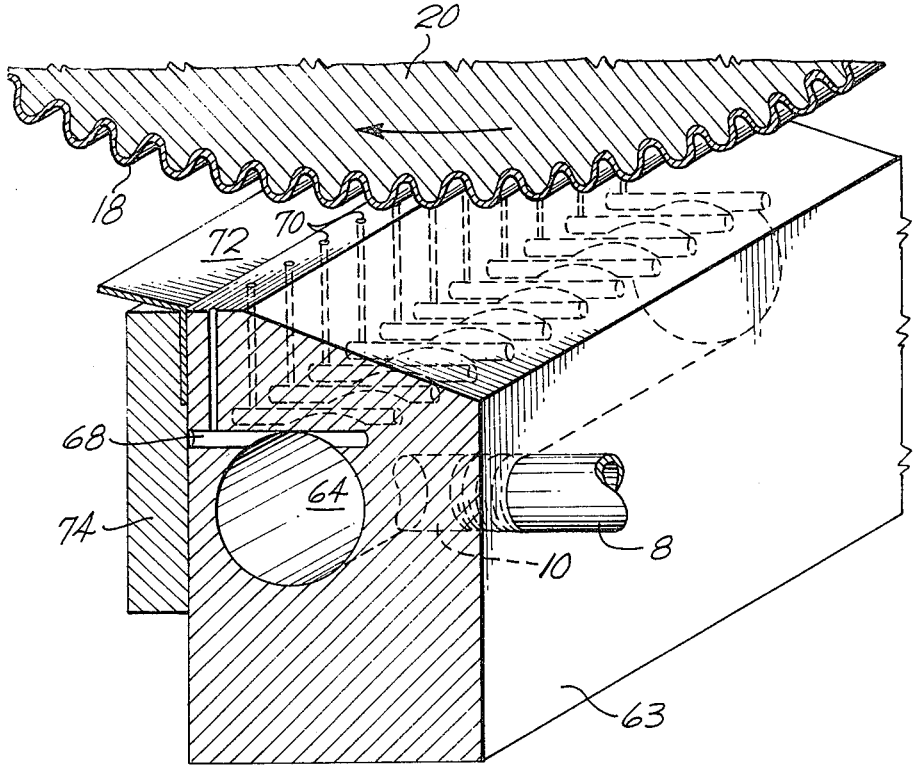
FIG. 5 is a slightly modified version of the extrusion head shown in FIG. 4.

FIG. 5 is a version of the extrusion head similar to that shown in FIG. 4, but lacking the land or dam downstream from the orifice openings.

A major problem with prior attempts to use extrusion heads for direct application of adhesive to corrugated medium, is illustrated in FIG. 6. The extrusion head is represented in cross-section at 80. The adhesive flows through orifices 82 and forms small beads 84 on the face of the extrusion head. These are retained by the land, or dam, 86. As the flute tips of the corrugated medium 18, held on lower corrugating roll 20, pass the glue applicator they tend to form deposits 88 which are localized on the downstream face of the flute tips. This poor distribution of the glue results in low adhesion strength when the medium is later bonded to a linerboard.

Figure 7:
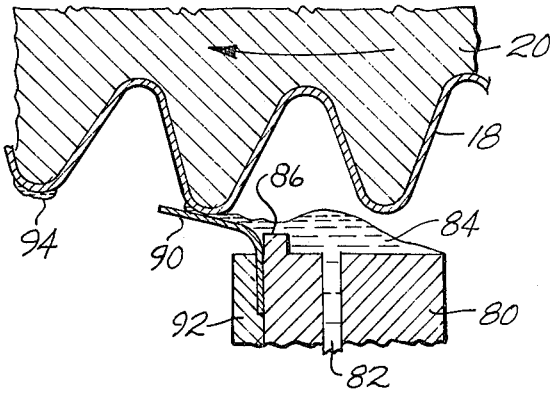
FIG. 7 is a similar diagrammatic view in cross-section of an extrusion head representative of the present invention as it applies adhesive to the flute tips of carrugated medium.

FIG. 7 illustrates how the present invention overcomes the above noted problem. As the flute tips pass the extrusion head and pick up adhesive from the puddle 84 they immediately contact the thin flexible spreader element 90. This picks up adhesive from the bead formed on the leading edge of the flute and spreads it more uniformly over the flute tip, as indicated at 94.

The particular application in which the extrusion head is used will, in large part, determine the mechanical requirements of the flexible spreader element. These requirements are not as severe when the extrusion head is used as a coater as they are when it is used as an adhesive applicator on a corrugator. In the later case, the lip must be sufficiently flexible to follow the contours of the flute without undue resistance or chatter. It must also have extremely high fatigue resistance since, in the course of a days operation, a lip may make anywhere between ten and one hundred million flexes, depending on operating speed and time in operation. While many materials have been found suitable for lip construction on coaters, among the preferred are stainless steel, phosphor bronze and beryllium copper. In general, this flexible lip, or spreader element, should have a thickness in the range of 0.10 to 0.26 mm. For use on a corrugator it is most preferred that the thickness be in the range of 0.12 to 0.20 mm. A preferred material for corrugators is a partially annealed beryllium copper alloy. In practice, a material known commercially as quarter hard has been found to be the most satisfactory. The hardness of the metal will also determine the radius of any bend in the spreader element. Normally, this should be as small as possible without inducing stress cracks on the outer radius of the bent portion. In practice, a radius of about 3 mm, as measured on the inner surface of the bend, has been found to be most practical.

While not normally necessary, the flexible spreader element may be backed by a resilient member, such as one made of a resilient foam or tubing. This could be advantageous as a damping mechanism when the particular physical parameters of the system tend to induce vibration or chatter in the spreader.

Figure 8:
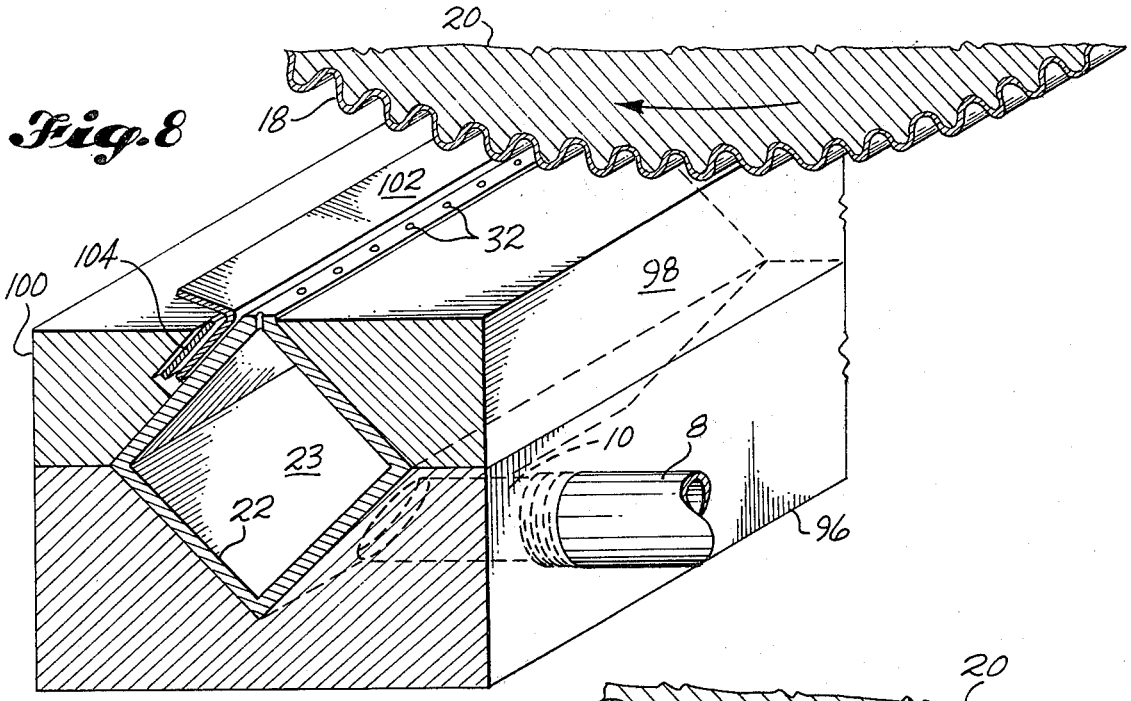
FIG. 8 is a partially cut away isometric view of an extrusion head slightly modified sfrom the one shown in FIG. 3.
Figure 9:
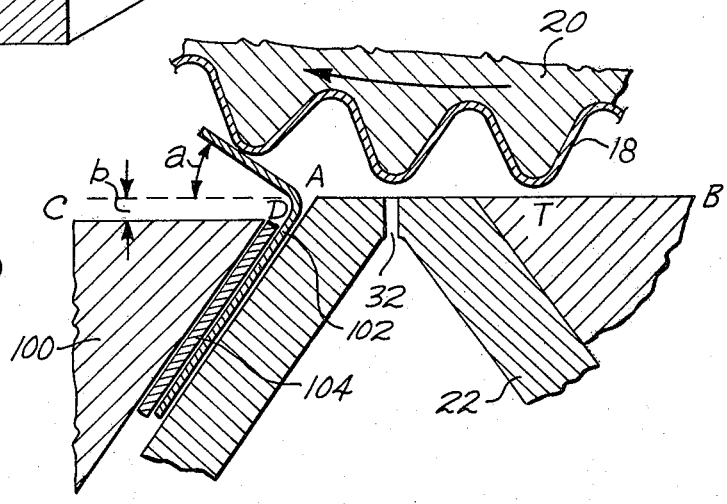
FIG. 9 is a magnified cross-section portion of the extrusion head shown in FIG. 8, better showing its relationship to the lower corrugating roll.

FIG. 8 represents a slightly modified version of the extrusion head shown in FIG. 3. This is the simplest to construct of all the version shown. Again, the manifold is based on a square tube 22 containing an interior chamber 23. Optionally, one edge can be milled flat to enable more precise drilling of the orifices 32. The square tube 22 held in a body block 96, partially held by retainer block 98 and is further retained by block 100. Block 100 also serves to retain the flexible spreader element 102 which is held tightly in place by a shim of appropriate thickness 104. The normal cap screws, or bolts, which will tie the retainer blocks to the body block, are not represented for sake of simplicity. There is one other difference between FIG. 8 and FIG. 3, which should be noted. In FIG. 3, the point of tangency T of the corrugating roll with the extrusion head is about at the line of the orifices. This point is moved forward in FIG. 8 and it is a preferred arrangement. The relationship is better seen in the enlarged cross-sectional view displayed in FIG. 9. Here the point of tangency T between the lower corrugating roll and the orifices is moved forward by a distance which is slightly greater than the tip to tip distance between adjacent flutes. Typically, in the application shown, the distance between the orifces 32 and the point of tangency T will be about 0.5 cm. The distance between orifices 32 and the base of the flexible spreader element 102 is also typically about 0.5 cm. These dimensions are not critical, however, and are best determined empirically. In a preferred version of the apparatus for either coating or adhesive applications, the contact angle a, as shown on FIG. 9, should be less than 30°. It may range as low as 0° but the best operation seems to be achieved when angle a is approximately 15° to 20°. This angle, of course, will vary on a corrugator as the spreader element is depressed by the passing flute tips.

When used as an adhesive applicator on a corrugating machine, the length of the flexible lip, or spreader element, is broadly critical. It should, in any case, be less than the tip to tip distance between two adjacent flutes. In practice, best adhesion strength is attained when the effective length of the spreader element is in the range of 0.75 to 0.95 of the tip to tip distance between adjacent flutes. The effective distance is normally measured from the center of the radius to the distal edge of the spreader element.

Normally, the upper surface of the retainer block 100 will be somewhat lower than the opening of the orifices. The plane containing line CD is depressed a distance b below the plane containing line AB in the illustration shown in FIG. 9. The distance b is not critical and can be arbitrarily determined. It should be sufficiently great so as to allow complete depression of the lip element 102 to a position which is roughly an extension of the line AB.

Whether or not a land or dam is advantageous downstream from the orifices is best determined empirically. This will be dependent on the material being coated, the rheological characteristics of the coating and the geometry of the particular system. In the versions of the present invention illustrated in FIGS. 2, 4, 6 and 7, the following dimensions were found advantageous. The adhesive was a hot melt type with a viscosity at application temperature of about 10,000 centipoise. Heights; i.e., elevation above the orifice openings, of 0.6 to 2.0 mm were satisfactory with about 1.5 mm preferred. Offset; i.e., distance downstream from the downstream edge of the orifice openings, was satisfactory in the range of 0.6 to 1.0 mm. The land width is broadly critical. In the range of 2.3 to 15.9 mm, a width of 6.4 mm gave somewhat better results.

EXAMPLE

The following example describes in detail the use of the extrusion head of this invention as an adhesive applicator on a corrugating machine. The extrusion head was constructed essentially according to the example shown in FIGS. 8 and 9. In addition to the structures illustrated there, it contained a series of internal electrical heaters designed to maintain a uniform elevated temperature along the length of the unit. The overall length of the extruder head was 2 m with an effective length of 1.9 m. A series of holes 0.14 cm in diameter were drilled on 0.25 cm centers. The spreader element was made of quarter hard beryllium copper 0.0178 cm in thickness. It was bent to an approximately 3 mm radius. The length of the spreader element was 1.92 m and its width was 0.71 cm. The extruder head was held against the lower roll and corrugating medium by two pneumatic cylinders adjusted to give about 540 N overall force. Stops were provided at each end so that a minimum clearance of 0.05 mm was maintained between the applicator head and the corrugated medium. During operation the extrusion head was supported on a hydraulic wedge of adhesive and lifted slightly off the stops. The point of tangency between the extrusion head and lower corrugating roll was about 0.5 cm ahead of the extrusion holes. In its relaxed state the spreader element extended at an angle of about 35° above the plane of the extruder head but during operation this angle averaged about 15° to 20°. The spreader element was located approximately 0.5 cm downstream from the line of orifices.

The material being corrugated was a 183 g/m$^2$ highly sized wet strength treated corrugating medium. This was combined at the single-facer with a highly sized wet strength treated Kraft liner having a basis weight of 278 g/m$^2$. The liner was coated on each face with low density polyethylene to a thickness of approximately 0.016 mm. Medium and liner were combined at an operation speed of 59.4 m/min using a high melt adhesive, Eastobond A-8, a trademarked product of Eastman Chemical Products, Inc., Kingsport, Tenn. This is one of a numbr of suitable commercially available products based on a combination of polyethylene resin with flow and viscosity modifiers and tackifiers. The adhesive has a ring and ball softening point of 103° C. and a viscosity at 177° C. of about 20,000 centipoise. Adhesive useage was 6.05 g/m$^2$.

The adhesive was supplied to the extrusion by a commercially available melter-pumper unit using a positive displacement gear pump to control flow rate. The liner board was preheated on its inner face to 80° C. while the hot melt adhesive was used at an average temperature of approximately 185° C.

One of the best measures of bond strength between medium and liner on single-faced board is pin adhesion, a standard test in the industry which measures the force necessary to peel the corrugated medium from the liner board. In this example pin adhesion of the combined single-faced board averaged 427 N.

The corrugator was able to run up to its maximum limit of about 200 m/min with no apparent change in bond strength or quality of the single-faced product.

Experience has shown that board made under similar operating conditions in which the spreader element was omitted would rarely have a pin adhesion value above about 380 N, and that values this high could only be obtained with increased adhesive useage. When a more conventional adhesive applicator was used with this product, such as that shown in commonly assigned U.S. Patent Application, Ser. No. 836,181, filed Sept. 23, 1977, it was necessary to use adhesive spreads in the range of 8 to 10 g/m$^2$ to obtain adhesion values in the range of those in the present example. This represents over a 50% increase in adhesive useage.

One previously unsolved problem with hot melt corrugating adhesives has been stringing between adjacent flute tips. This spider web-like effect is quite wasteful of the expensive adhesive. About 20% of the applied material has been rendered non-functional in these strings. Quite surprisingly, the present extrusion head has almost completely eliminated flute to flute stringing. The reasons for the beneficial effect are not well understood.

The extruder head has also been found to be an effective adhesive applicator in the corrugating process with materials other than hot melts. As one example, a corrugated board was successfully made using a conventional aqueous starch adhesive having approximately a 34% solids content.

The extruder head has also been successfully used in non-adhesive applications. It has been shown effective in applying paper coatings which would normally be applied at either a size press or a more conventional off-machine coater such as a trailing blade type. The present extrusion head is much less massive and expensive than these more conventional types of coaters.

Figure 10:
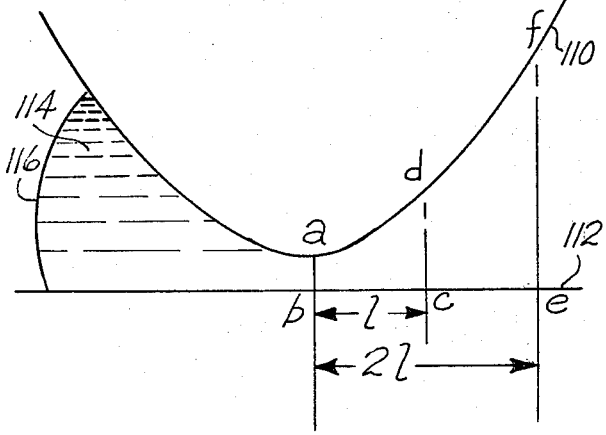
FIG. 10 is a partially diagrammatic cross-section of the glueline at a flute tip in combined corrugated board made on conventional equipment.
Figure 11:
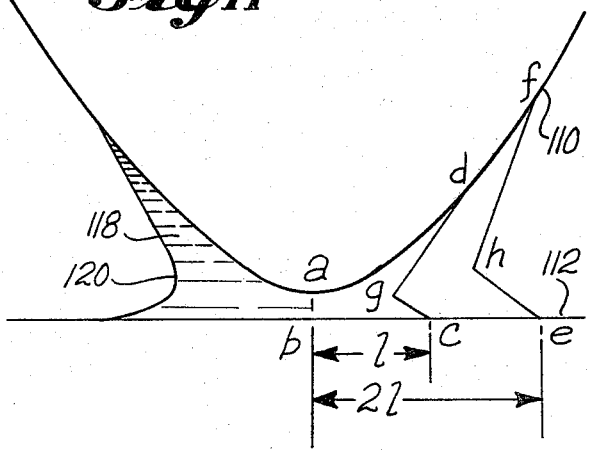
FIG. 11 is a partially diagrammatic cross-section at the flute tip of combined board using the extrusion head of the present invention as the adhesive applicator.

It is not entirely clear why the extruder head of the present invention results in high adhesion values with reduced adhesive usage. While applicant does not wish to be bound by any explanation, the following phenomenon appears to account for this superior performance. Reference is now made to FIGS. 10 and 11. The left side of FIG. 10 is a stylized illustration of a cross-section of the glue bond at a flute tip in conventional combined corrugated board. The outer surface of the corrugating medium 110 is held to the inner surface of the liner 112 by adhesive bead 114. Normally, this adhesive is applied to the flute tips from a film on a roll type applicator. This results in a small bead of adhesive which is pressed into the shape shown in FIG. 10 by the action of the combining roll at the single facer. In this case a positive meniscus 116 results. The right side of this figure models the relationship between the width of the glue bond and glue useage. The corrugating medium at this point can be presumed to approximate a parabola. For that reason, as the width of the glue bead increases the glue volume will increase in a cubic relationship. Thus, if the width of the glue bead is l, the volume of glue used is proportional to the cross-sectional area defined as a b c d. If the width of the glue bead increases to 2l, the glue volume approximated by the area a b e f which will represent roughly eight times the volume of adhesive as does the cross section a b c d. In the present invention, the adhesive is wiped much more uniformly around the flute tip. When the medium and liner are mated at the combining roll the glue bead assumes a cross-section similar to that shown at 118. In this case the adhesive bead has a negative meniscus 120. Referring to the right hand side of this figure, the volume of a glue bead of length l will be directly proportional to the area defined by a b c g d, while the area of a glue bead of length 2l will be defined by a b e h f. In this case, the volume of glue used more nearly approximates a square relationship than a cubic relationship. Thus, doubling the width of the glue bead will result in an increased useage of only about four times as compared to eight times for conventional technology. Adhesion seems to be directly related to the area of the glue line bonding the medium to the liner. Thus, within limits, a broader glue line will produce higher adhesion values.

It should be apparent to one skilled in the art that many variations can be made without departing from the spirit of this invention. For example, the extruder head could have a slit rather than a line of drilled orifices. It is also apparent that the device would have many uses other than glue application or paper coating. Many other changes and modifications may be made without departing from the spirit of the disclosure or the scope of the appended claims.

What is claimed is:

1. In a corrugated container board manufacturing apparatus having means for forming corrugations in a generally planar corrugating medium in which the corrugations have a predetermined tip-to-tip distance between adjacent flutes, and means for applying an adhesive to the flute tips, the improvement which comprises:

a. an elongate adhesive extrusion head operatively associated with the machine at a location downstream from the point at which the corrugations are formed, said head being in communication with a source of liquid adhesive material, said head further being of a size and shape that can be located closely adjacent to the moving corrugated medium in order to transfer adhesive thereto from an application surface on the head, and b. a relatively thin, flexible spreader element located parallel to and downstream from the application head, said element having one longitudinal edge attached to the extrusion head and a free longitudinal edge raised above the level of the application surface so that it is in wiping contact with the tips of the moving corrugated flutes, said spreader element having an effective length which is less than the tip-to-tip distance between adjacent flutes so as to improve adhesive spread uniformity on the flute tips without significant adhesive removal.

2. The applicator of claim 1 in which the extrusion head contains a manifold having a multiplicity of side-by-side orifices in the application surface, said orifices being in communication with the adhesive source.

3. The applicator of claim 1 in which the extrusion head contains an elongated slit in the application surface, said slit being in communication with the adhesive source.

4. The applicator of claim 1 where the corrugating means is a paperboard corrugating apparatus.

5. The applicator of claim 4 in which the thickness of the flexible spreader element is in the range of 0.10 to 0.26 mm.

6. The applicator of claim 4 in which the extrusion head is located at the single facer station of the corrugator.

7. The applicator of claim 4 in which the extrusion head is located at the double backer station of the corrugator.

8. The applicator of claim 1 in which the effective length of the flexible spreader element is in the range of 0.75 to 0.95 times the tip-to-tip flute distance of the corrugated medium.

9. The applicator of claims 1, 8 or 5 in which the flexible spreader element is constructed of a beryllium copper alloy which is at least partially annealed.

10. The applicator of claim 1 in which the spreader element contacts the adhesive receiving surface at an angle less than 30°, as measured from the upstream side of the surface.

* * * * *